US005655187A

United States Patent [19]

Watanabe et al.

[11] Patent Number: 5,655,187

[45] Date of Patent: Aug. 5, 1997

[54] IMAGE FORMING APPARATUS FOR PREVENTING DISCHARGE PRODUCTS FROM CONTACTING A PHOTOSENSITIVE BODY

[75] Inventors: Toshio Watanabe; Tomohisa Suzuki; Shigeru Tanaka, all of Ebina, Japan

[73] Assignee: Fuji Xerox Co., Ltd. Tokyo, Japan

[21] Appl. No.: 569,904

[22] Filed: Dec. 8, 1995

[30] Foreign Application Priority Data

Dec. 16, 1994 [JP] Japan ..... 6-313343

[51] Int. Cl.[6] ..... G03G 15/045

[52] U.S. Cl. ..... 399/172; 399/171; 250/324; 361/225

[58] Field of Search ..... 355/221–226; 250/324–326; 361/225, 230; 430/937; 399/172, 171

[56] References Cited

U.S. PATENT DOCUMENTS

| | | | |
|---|---|---|---|
| 3,983,393 | 9/1976 | Thettu et al. | 250/326 |
| 4,388,274 | 6/1983 | Rourke et al. | 250/325 X |
| 4,984,018 | 1/1991 | Andou et al. | 355/200 |
| 5,087,943 | 2/1992 | Creveling | 355/215 |
| 5,351,111 | 9/1994 | Takafuji et al. | 355/221 |

FOREIGN PATENT DOCUMENTS

| | | |
|---|---|---|
| 58-190968 | 11/1983 | Japan . |
| 2-29052 | 2/1990 | Japan . |
| 2-111142 | 9/1990 | Japan . |
| 3-81952 | 8/1991 | Japan . |
| 4-53978 | 2/1992 | Japan . |
| 4-125663 | 4/1992 | Japan . |
| 4-128774 | 4/1992 | Japan . |
| 4-234774 | 8/1992 | Japan . |

OTHER PUBLICATIONS

Abstract of JP–A–07281565, Published Oct. 27, 1995.

Abstract of JP–A–07168423, Published Jul. 4, 1995.

Abstract of JP–A–05281829, Published Oct. 29, 1993.

Abstract of JP–A–05019591, Published Jan. 29, 1993.

Abstract of JP–A–04181269, Published Jun. 29, 1992.

Abstract of JP–A–04016964, Published Jan. 21, 1992.

Abstract of JP–A–63103271, Published May 7, 1988.

*Primary Examiner*—R. L. Moses

*Attorney, Agent, or Firm*—Oliff & Berridge

[57] ABSTRACT

An image forming apparatus includes an opening portion that opens toward a photosensitive body and has a stagnant portion in which discharge products produced by a discharging means stagnate. A partition member is disposed in the vicinity of an opening of the opening portion, the opening opposing a photosensitive body, the partition member preventing discharge products that fall from the stagnant portion from falling directly into contact with the photosensitive body.

6 Claims, 3 Drawing Sheets

IMAGE FORMING APPARATUS FOR PREVENTING DISCHARGE PRODUCTS FROM CONTACTING A PHOTOSENSITIVE BODY

BACKGROUND OF THE INVENTION

The invention relates to an image forming apparatus of, for example, the electrophotography type which may be used in a copier, a printer, a facsimile apparatus, or the like.

Conventionally, image forming apparatuses employing the electrophotography technique are popularly used. In such an image forming apparatus, usually, a photosensitive body (for example, a photosensitive drum) which is formed into a drum or a belt is uniformly charged, and light carrying image information which is recorded on, for example, an original impinges on the photosensitive drum so that an electrostatic latent image is formed on the photosensitive drum. The electrostatic latent image is developed by a developer (toner), and the developed image is transferred onto a sheet directly or via a transfer drum or the like, thereby obtaining a print (copy) image. In such an image forming apparatus of the electrophotography type, a corona discharger for charging or destaticizing the photosensitive drum is widely used.

When a corona discharger is operated, discharge products such as ozone and nitrogen oxides are produced. Such discharge products are harmful to the apparatus and also to the environment. Usually, a forced air flow caused by an exhaust blower or the like is emitted to the outside of the apparatus through a filter so that discharge products are decomposed or adsorbed by the filter, or the forced air flow is emitted to the outside of the apparatus through an exhaust duct having an inner wall to which a substance which decomposes or adsorbs discharge products is applied, whereby the discharge products are decomposed or adsorbed by the applied layer (for example, see Japanese patent publication (Kokai) No. SHO.58-190968, Japanese utility model publication (Kokai) Nos. HEI.2-09052, and HEI.2-111142, and Japanese patent publication (Kokai) No. HEI.4-128774).

Because of the internal structure of the apparatus, however, a stagnant portion may be formed which is, for example, in the vicinity of the corona discharger and into which discharge products easily enter, but which is not affected by the air flow. In the case where the opening of such a stagnant portion or that of an opening portion which communicates with the stagnant portion and is formed as an air flow path is directed downward or obliquely downward and opposes the photosensitive drum, there may arise a situation in which discharge products flow out through the opening, for example, after the operation of the apparatus is ended, and then contact the photosensitive drum because such discharge products contain components heavier than air.

When color superimposition such as color copying is to be conducted, air is exhausted from the portion above a scorotron so that toner is prevented from adhering to a grid. In this case, particularly, discharge products easily move to the surface of a photosensitive body.

A photosensitive drum which is used in an image forming apparatus of the electrophotography type has a tendency to very sensitively react due to the environment so as to deteriorate its properties. Since such a photosensitive drum must always start operation under the same initial conditions, it stops in a fixed initial state in which the same portion is always directed in the same direction.

During a stop period, therefore, discharge products are always in contact with the same portion of the photosensitive drum, with the result that only that portion is locally deteriorated. This produces a problem in that a distinct change in density and contrast appears in a part of an image printed (copied) on a sheet.

In order to prevent such a problem from occurring, it may be contemplated to design the apparatus so as not to form a stagnant portion. In many cases, however, it is very difficult to adopt such a design because of restriction due to the internal structure of the apparatus.

SUMMARY OF THE INVENTION

In view of the above-mentioned circumstances, it is an object of the invention to provide an image forming apparatus which, even when a stagnant portion such as described above is formed, an adverse effect on a photosensitive body is sufficiently suppressed so that the photosensitive body can attain a long life.

(Aspect 1)

The first image forming apparatus of the invention which can attain the object comprises:

- latent image forming means for forming a latent image on a photosensitive body;
- developing means for developing the latent image to form a developed image;
- transferring means for transferring the developed image onto a transfer body;
- discharging means comprising a corona discharger which conducts a discharge to charge or destaticize the photosensitive body;
- an opening portion which opens downward or obliquely downward toward the photosensitive body and which has at least partly a stagnant portion in which discharge products produced by a discharge caused by the discharging means stagnate; and
- a partition member which is disposed in the vicinity of an opening of the opening portion, the opening opposing the photosensitive body, the partition member preventing discharge products which fall from an interior of the stagnant portion, from further falling to directly contact with the photosensitive body.

(Aspect 2)

The second image forming apparatus of the invention which can attain the object comprises:

- latent image forming means for forming a latent image on a photosensitive body;
- developing means for developing the latent image to form a developed image;
- transferring means for transferring the developed image onto a transfer body;
- discharging means comprising a scorotron discharger which conducts a discharge to charge or destaticize the photosensitive body and which has a grid, a substance which decomposes or adsorbs discharge products being disposed on a face of the grid which opposes a discharging portion;
- an opening portion which is directed downward or obliquely downward toward the photosensitive body and which has at least partly a stagnant portion in which discharge products produced by a discharge caused by the discharging means stagnate; and
- a partition member which is disposed in the whole of an opening of the opening portion, the opening opposing the photosensitive body, the partition member being continuously adjacent to the grid.

(Aspect 3)

In the first or second image forming apparatus of the invention, the apparatus may further comprise:

discharging means comprising a scorotron discharger; and a partition member which is elongated integrally with a member for forming a grid of the scorotron discharger.

(Aspect 4)

In the first or second image forming apparatus of the invention, the apparatus may further comprise:

a partition member having a flat plate portion which extends along the photosensitive body; and a bent portion which elongates from an edge of the flat plate portion and bends in a direction along which the distance between the bent portion and the photosensitive body is gradually increased.

(Aspect 5)

In each of the above-mentioned image forming apparatuses of the invention, the apparatus may further comprise:

an erase lamp at a position opposite to the discharging means with the opening portion between, the erase lamp destaticizing the photosensitive body; and a partition member disposed at a position at which light emitted from the erase lamp and advancing to a portion of the photosensitive body is blocked, the portion opposing the discharging means.

(Aspect 6)

In the first or second image forming apparatus of the invention, the apparatus may further comprise a partition member which is disposed at least in a face of the opening portion in the vicinity of an opening opposing the photosensitive body, the face opposing the stagnant portion, the partition member made of a substance which decomposes or adsorbs discharge products which fall from an interior of the stagnant portion.

(Aspect 7)

In the first or second image forming apparatus of the invention, the apparatus may further comprise an opening portion which opens downward or obliquely downward toward the photosensitive body and which has at least partly a stagnant portion in which discharge products produced by a discharge caused by the discharging means stagnate, a layer made of a material which decomposes or adsorbs discharge products being formed on an inner wall.

In the first image forming apparatus of the invention, since the partition member is disposed in the vicinity of the opening of the opening portion which opening opposes the photosensitive body, discharge products in the opening portion are prevented from falling and concentrically contacting a specific portion of the photosensitive body. Consequently, the photosensitive body is prevented from being locally deteriorated, so that the photosensitive body can attain a long life.

In the first image forming apparatus of the invention, the grid electrode may be extended so as to form a partition plate. In this case, the number of parts is prevented from being increased, so as to suppress the cost.

In the first image forming apparatus of the invention, the partition plate may comprise the flat plate portion and the bent portion. In this case, it is possible to further reduce the possibility that discharge products contact the photosensitive body.

In the first image forming apparatus of the invention, the partition plate, for example, the bent portion of the partition plate may serve also as a light shield plate. Also in this case, the number of parts is prevented from being increased, so as to suppress the cost.

In the second image forming apparatus of the invention, the filter is disposed, or the layer is formed. Consequently, discharge products falling in the interior of the opening portion are decomposed or adsorbed, and hence the discharge products do not contact the photosensitive body. In the same manner as the first image forming apparatus of the invention, therefore, the photosensitive body is prevented from being locally deteriorated, and the photosensitive body can attain a long life.

DETAILED DESCRIPTION OF THE PREFERRED EMBODIMENTS

Hereinafter, embodiments of the invention will be described.

Figure 1:
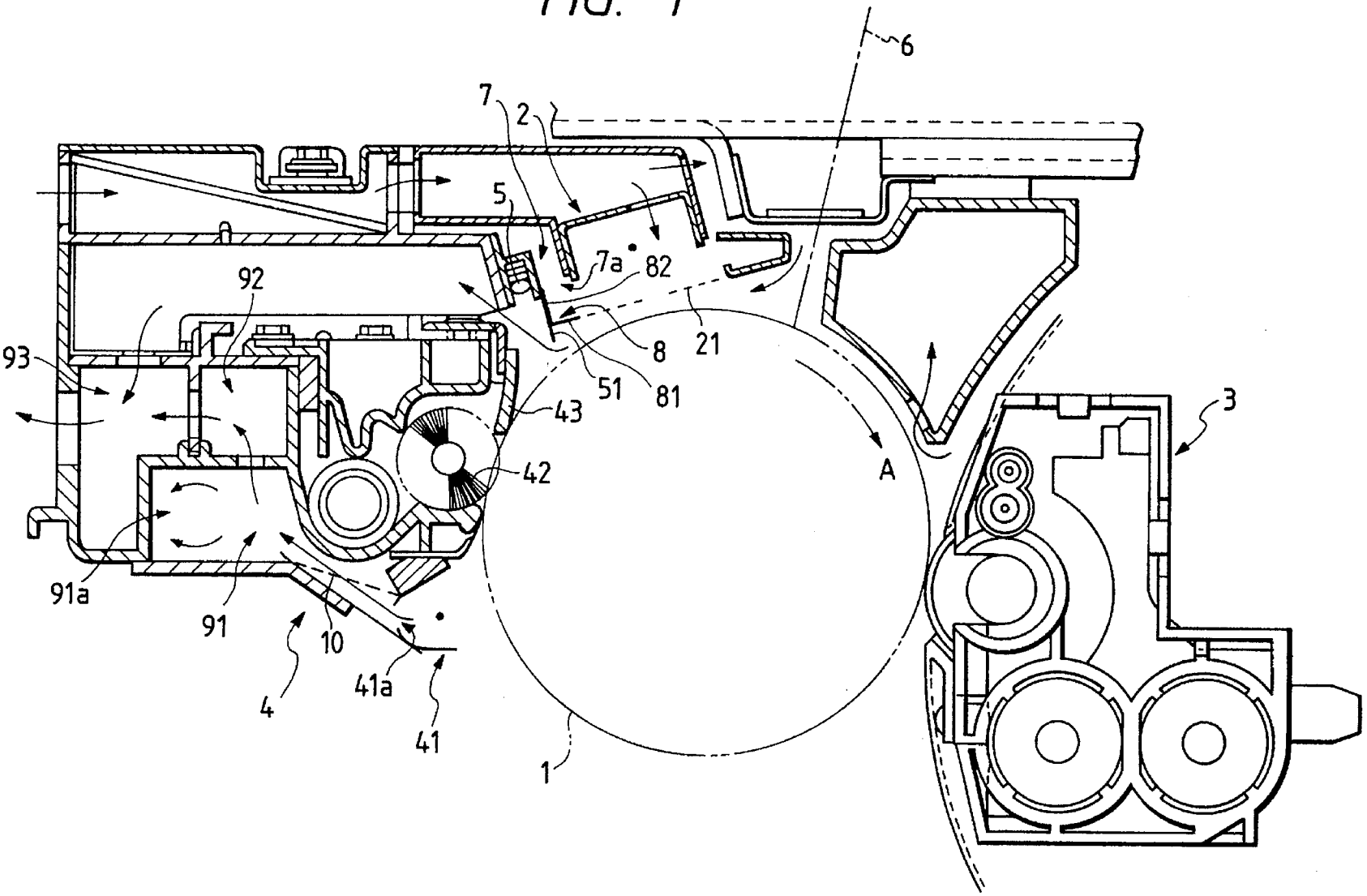
FIG. 1 is a diagram showing an embodiment of the image forming apparatus of the invention.

FIG. 1 is a diagram showing an embodiment of the image forming apparatus of the invention.

A photosensitive drum 1 is disposed at the center of FIG. 1. The photosensitive drum 1 is rotated in the direction of the arrow A. A primary charging scorotron discharger 2, a developing device 3, a cleaning device 4, and an erase lamp 5 are arranged as main components around the photosensitive drum 1. Although not shown in the figure, an image writing device which generates a laser beam 6 for writing a latent image, and a transfer device which transfers a developed image formed on the photosensitive drum 1 onto a predetermined sheet are also disposed.

The photosensitive drum 1 is uniformly charged by the primary charging scorotron discharger 2, and an electrostatic latent image is formed on the photosensitive drum 1 by being irradiated by the laser beam 6 carrying image information. The electrostatic latent image is developed by the developing device 3 to form a developed image on the photosensitive drum 1. The developed image on the photosensitive drum 1 is transferred onto a sheet by the transfer device which is not shown. The sheet onto which the developed image has been transferred is transported to a fixing device (not shown) to be subjected to a fixing process, and then transported to the outside of the apparatus.

After the transfer process, the photosensitive drum 1 is cleaned by the cleaning device 4. In the cleaning device 4, the photosensitive drum 1, and toner remaining on the photosensitive drum 1 are charged or destaticized to a state suitable for cleaning by a cleaning corotron discharger 41 and the toner remaining on the surface is stirred by a brush 42. Then the remaining toner is scraped off by a blade 43.

After the cleaning, the photosensitive drum 1 is destaticized by light irradiation caused by the erase lamp 5 to return to the initial state, and uniformly charged again by the primary charging scorotron discharger 2 so as to be used in the next image forming process.

In FIG. 1, the solid arrows indicate the air flow. Air is caused by the rotation of an exhaust blower (not shown) to flow in the apparatus along the arrows shown in the figure, and finally flows out to the outside of the apparatus. As a result of the operations of the primary charging scorotron discharger 2 and the cleaning corotron discharger 41, discharge products such as ozone and nitrogen oxides are produced. The discharge products are transported together with the air flow. A filter which decomposes the discharge products is disposed in the vicinity of an opening through which the interior of the apparatus communicates with the outside of the apparatus, so that the discharge products are decomposed by the filter.

Figure 2:
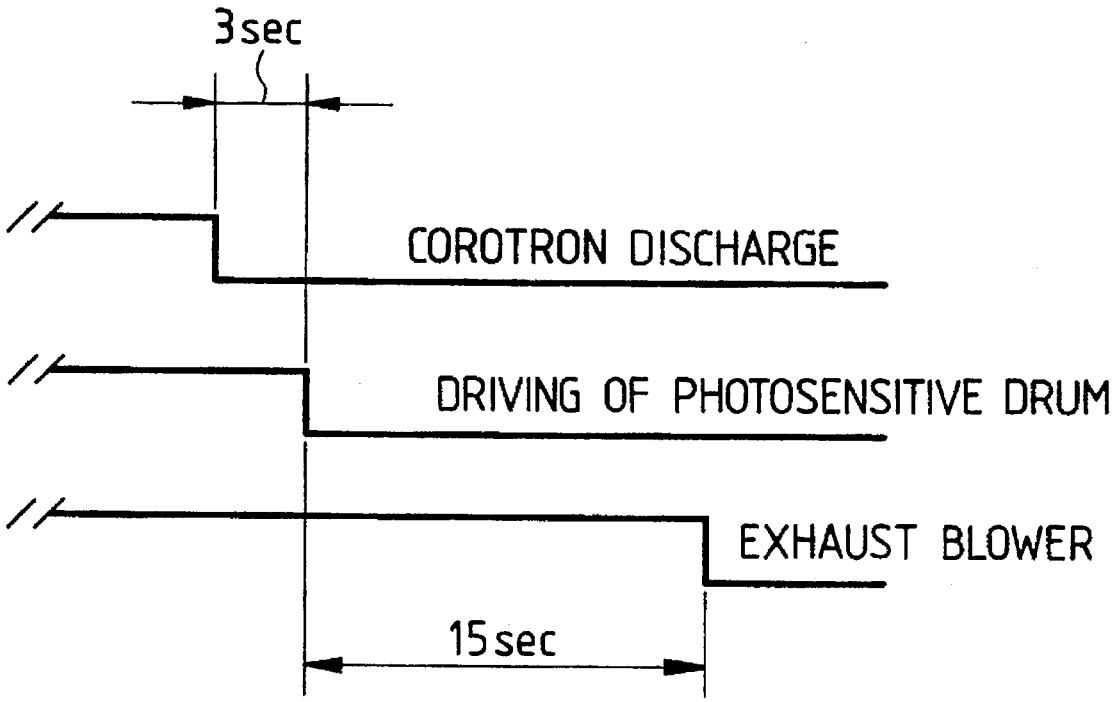
FIG. 2 is a timing chart of the operation stop process of the image forming apparatus shown in FIG. 1.

FIG. 2 is a timing chart of the operation stop process of the image forming apparatus shown in FIG. 1.

When the image forming process is ended, firstly, the primary charging scorotron discharger 2 and the cleaning corotron discharger 41 cease the discharge operation, and the driving of the photosensitive drum 1 is stopped after about 3 seconds. At this time, the photosensitive drum 1 is always stopped at a rotational position which is previously determined. After a lapse of about 15 seconds, the exhaust blower is stopped.

In the apparatus shown in FIG. 1, an opening portion 7 is formed between the primary charging scorotron discharger 2 and the erase lamp 5. The opening portion 7 has an opening which is downward directed to the photosensitive drum 1, and is not provided with an air outlet other than the opening. Originally it is preferable not to dispose the opening portion 7. Since a part of a holding portion (not shown) for a member which periodically cleans a corotron wire moves reciprocally in the opening portion 7, however, the opening portion 7 is indispensable. The whole of the opening portion 7 serves as a stagnant portion in which discharge products may stagnate. When discharge products once enter the stagnant portion, they stagnate in the portion because there is no outlet. Alternatively, discharge products pass through the grid so as to be treated and then flow into the vicinity of the photosensitive body, thereby producing no problem. The stagnating discharge products are not thoroughly emitted from the opening portion 7 during a short period from the stop of the discharge to that of the exhaust blower, and slowly fall through the opening 7*a* of the opening portion 7 after the apparatus is completely stopped. When no countermeasure is taken, therefore, the discharge product further fall along a light shield plate 51 which prevents the light of the erase lamp 5 from entering the region of the photosensitive drum 1 that is to be charged by the primary charging scorotron discharger 2, and then contact with the surface of the photosensitive drum 1. This results in that the surface portion is locally deteriorated.

In the image forming apparatus shown in FIG. 1, a stainless steel plate constituting the grid 21 of the primary charging scorotron discharger 2 is extended into the space below the opening portion 7, thereby forming a flat plate portion 81 of a partition member 8. The plate is bent along the light shield plate 51 and in the direction along which the distance between the plate and the photosensitive drum 1 is gradually increased, so that a bent portion 82 of the partition member 8 is formed. In this way, the image forming apparatus shown in FIG. 1 is provided with the partition member 8 which is bent into an L shape. Therefore, discharge products falling from the interior of the opening portion 7 are blocked by the partition member 8, thereby preventing the discharge products from concentrically contacting at least a specific local portion of the surface of the photosensitive drum 1. This suppresses the deterioration of the photosensitive drum 1.

In the embodiment, a substance which decomposes or adsorbs discharge products is applied or pasted to the discharge device-opposing face of the stainless steel plate constituting the grid 21 and the partition member 8, so that discharge products falling from the opening portion 7 contact with the partition member 8 and are decomposed or adsorbed by the partition member 8, whereby the photosensitive drum 1 is further surely prevented from being deteriorated. Various kinds of substances or the like which can decompose or adsorb discharge products are known. Preferably, activated carbon, "FINGUARD FILTER" manufactured by KABUSHIKI KAISHA OKAYAMA, etc. are used.

On the other hand, in the image forming apparatus shown in FIG. 1, discharge products which are produced as a result of the operation of the corotron discharger 41 of the cleaning device 4 are emitted through an opening 41a formed behind the corotron discharger 41, and also through opening portions 91, 92, and 93. A stagnant portion 91*a* in which air does not smoothly flow is formed in the innermost region of the opening portion 91. Such a cul-de-sac may be inevitably formed under the necessity of arranging various parts and a control device which are not shown. Discharge products easily stagnate in such a stagnant portion 91*a*. When no countermeasure is taken, in the same manner as the case of the opening portion 7, there arises a situation in which discharge products which once stagnate in the stagnant portion 91*a* slowly fall after the apparatus is completely stopped and then contact with the surface of the photosensitive drum 1 so that the surface portion of the photosensitive drum 1 which portion opposes the cleaning corotron discharger 41 when the photosensitive drum is stopped is easily deteriorated in a local manner.

To remedy this, in the embodiment, a filter 10 which decomposes or adsorbs discharge products is disposed in the vicinity of the opening of the opening portion 91 which opening is on the side of the photosensitive drum 1. Discharge products produced in the cleaning corotron discharger 41 are decomposed or adsorbed by the filter 10 also when the discharge products flow from the cleaning corotron discharger 41 toward the opening portion 91. Also when discharge products which once stagnate in the stagnant portion 91*a* fall after the apparatus is stopped, the discharge products are decomposed or adsorbed by the filter 10. Thereby, the photosensitive drum 1 is prevented from being locally deteriorated.

As seen from the above description, in the image forming apparatus shown in FIG. 1, both of an embodiment of the first image forming apparatus of the invention, and an embodiment of the second image forming apparatus of the invention are embodied.

Figure 3:
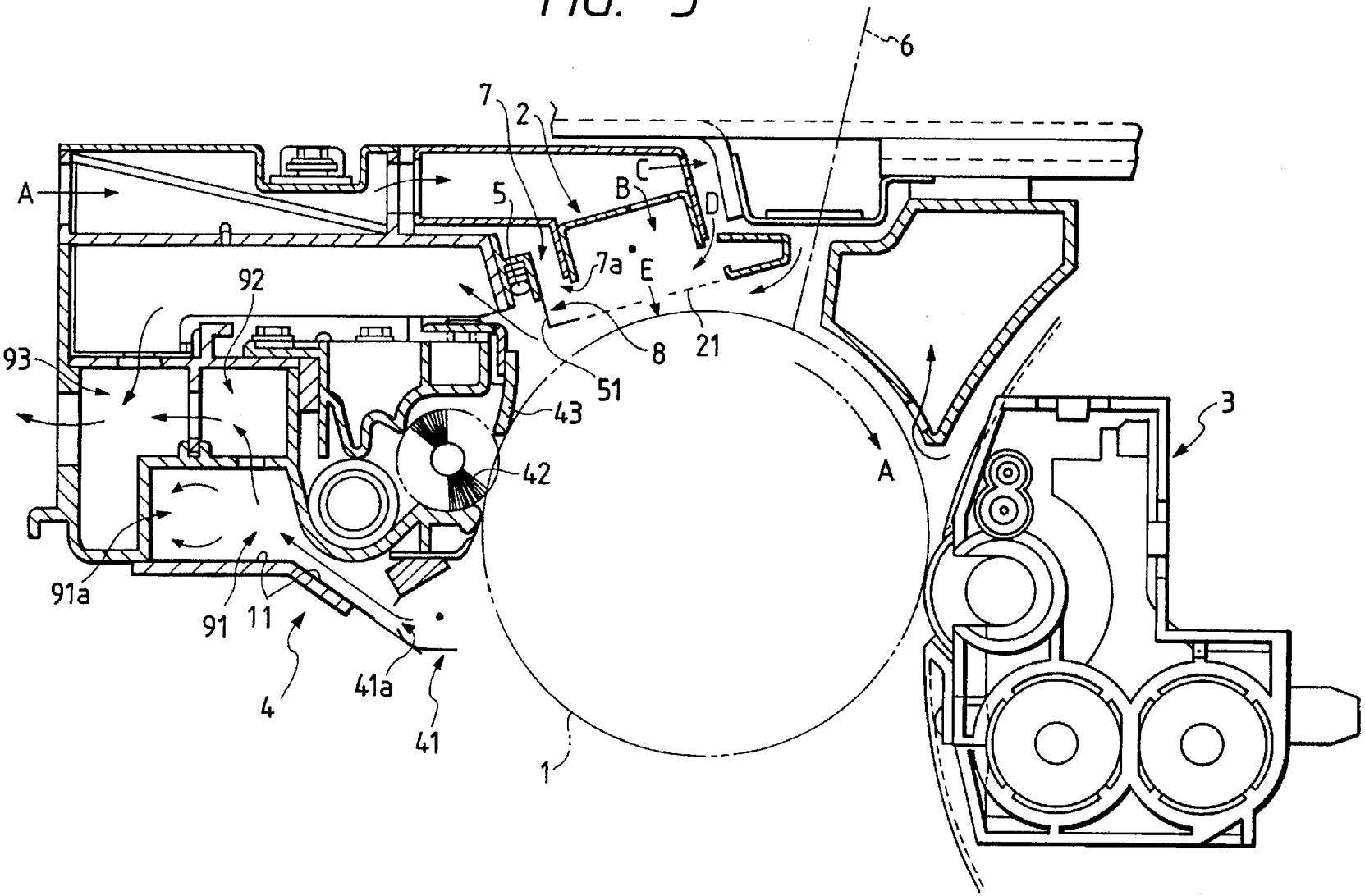
FIG. 3 is a diagram showing another embodiment of the image forming apparatus of the invention.

FIG. 3 is a diagram showing another embodiment of the image forming apparatus of the invention. The components identical with those of the image forming apparatus shown in FIG. 1 are designated by the same reference numerals used in FIG. 1, and only points of difference will be described.

In the image forming apparatus shown in FIG. 3, a stainless steel plate constituting the grid 21 of the primary charging scorotron discharger 2 is extended into the space below the opening portion 7, and further extended while being bent in the direction along which the distance between the plate and the photosensitive drum 1 is gradually increased. The single stainless steel plate serves as the grid 21 and the partition member 8, and also as the light shield plate 51. The partition member 8 and the light shield plate 51 function in the same manner as those of FIG. 1. When the grid 21, the partition member 8, and the light shield plate 51 are integrated into one part as described above, the number of parts can be further decreased.

Even when moved by an air flow toward the photosensitive body, therefore, substances produced by the discharger 2 always pass through the partition member 51 or the grid 21, and hence do not directly contact with the photosensitive body but contact with the photosensitive body after decomposed or adsorbed by the above-mentioned member. Consequently, the photosensitive body is not affected by the substances.

In the image forming apparatus shown in FIG. 3, in place of the filter 10 disposed behind the cleaning corotron discharger 41 in the image forming apparatus shown in FIG. 1, a layer 11 in which a substance which decomposes or adsorbs discharge products is applied is formed at the bottom region of the inner wall face of the opening portion 91. While falling through the interior of the opening portion 91, discharge products which once stagnate in the stagnant portion 91*a* contact with the layer 11 to be decomposed or adsorbed by the layer. In the same manner as the case where the filter 10 (see FIG. 1) is disposed, therefore, the photosensitive drum 1 is prevented from being locally deteriorated.

As seen from the above description, also in the image forming apparatus shown in FIG. 3, both of an embodiment of the first image forming apparatus of the invention, and an embodiment of the second image forming apparatus of the invention are embodied.

In the embodiments described above, the partition member 8 disposed in the vicinity of the opening of the opening portion 7 serves also as the grid 21 of the primary charging scorotron discharger 2, or as the grid 21 and the light shield plate 51. Alternatively, the partition member 8 may serve also as the light shield plate 51 only, or may be structured as a member independent from the grid. 21 and the light shield plate 51.

In the embodiments described above, only one of the filter 10 and the layer 11 which decompose or adsorb discharge products is disposed behind the cleaning corotron discharger 41. Alternatively, both the components may be disposed so that discharge products are decomposed or adsorbed more surely.

As shown in FIG. 3, air exhausted in the direction of A advances in the directions of B, C, and D from the upper portion of the scorotron, and then flows to the grid, the partition member, the stagnant portion, etc. The air flow contains discharge products produced during a discharge. When the discharge products adhere to the photosensitive body, therefore, the photosensitive body is deteriorated as described above.

In a color image forming apparatus, when toner once adheres to a grid of a scorotron serving as a discharger, unevenness among colors may occur. In order to prevent such color unevenness from occurring, the configuration in which air is exhausted from A to B, C, and D is usually employed. By contrast, in the suction type, discharge products produced in the discharging portion do not move or fall toward the surface of the photosensitive body but are sucked, and hence the above-mentioned problem hardly arises. However, toner of the previous color easily adheres to the grid so that the potential conditions are different among colors. In color development, these different potentials appear as color unevenness. When discharge is to be conducted by using a scorotron and a grid, a substance which adsorbs or decomposes discharge products is disposed on the grid itself so as to oppose the stagnant portion, and the partition member is disposed in the whole area of the opening portion opposing the photosensitive body, in such a manner that the partition member is continuously adjacent to the grid. Consequently, air which moves or fall toward the photosensitive body and contains discharge products always passes over the substance which adsorbs or decompose the discharge products, in the direction of E, with the result that no problem is produced.

In other words, discharge products are adsorbed or decomposed by either the partition member or the grid.

This is applicable also to air containing discharge products which once stagnate in the stagnant portion and fall during a period when the photosensitive body is stopped. That is, such discharge products are similarly adsorbed decomposed.

In other words, a substance which adsorbs or decomposes discharge products always exists between the discharging portion of the scorotron and the surface of the photosensitive body.

As described above, according to the invention, the space including the vicinity of the discharger and opposing the photosensitive body is partitioned by the grid and the partition member into the space on the side of the photosensitive body and that of the discharging portion. Therefore, discharge products produced in the discharging portion are prevented from directly contacting with the photosensitive body, and surely pass over the grid or the partition member. The falling air flow causes the discharge products to pass through the decomposing or adsorbing substance, so that only unharmful air contacts with the photosensitive body. Consequently, the photosensitive body is prevented from being locally deteriorated, and the life of the photosensitive body can be prolonged.

When air containing discharge products which are produced as a result of the discharge operation of the discharging means is to fall on the surface of the photosensitive body (the invention can achieve the effect not only in a stop period but also in a period when air is moved by means of vacuuming or the like), the air always passes through the portion where a substance which decomposes or adsorbs the discharge products is disposed on the face opposing the discharging portion. Consequently, the photosensitive body is prevented from being damaged.

In other words, in the case where a partition member such as that set forth in Aspect 2 is used, discharge products falling on the portion impinge on the partition member, and then passes through the grid of the scorotron discharger which is continuously adjacent to the partition member and in which a substance which decomposes or adsorbs the discharge products is disposed on a face opposing the discharging portion. Therefore, the invention can achieve the effect.

When the partition member has an opposing face made of a substance which decomposes or adsorbs discharge products as set forth in Aspect 6, discharge products are decomposed or adsorbed by the portion, and hence the invention can achieve a further excellent effect.

What is claimed is:

1. An image forming apparatus comprising:

latent image forming means for forming a latent image on a photosensitive body;

developing means for developing the latent image to form a developed image;

transferring means for transferring a corona discharger which conducts a discharge to charge or destaticize said photosensitive body;

an opening portion which opens downward or obliquely downward toward said photosensitive body and which has at least partly a stagnant portion in which discharge products produced by a discharge caused by said discharging means stagnate; and a partition member which is disposed in the vicinity of an opening of said opening portion, said opening opposing said photosensitive body, said partition member preventing discharge products which fall from an interior of said stagnant portion, from further falling to directly contact with said photosensitive body, wherein said partition member has a flat plate portion that extends along said photosensitive body and a bent portion that elongates from an edge of said flat plate portion and bends in a direction along which the distance between said bent portion and said photosensitive body is gradually increased.

2. An image forming apparatus comprising:

latent image forming means for forming a latent image on a photosensitive body;

developing means for developing the latent image to form a developed image;

transferring means for transferring the developed image onto a transfer body;

discharging means comprising a scorotron discharger which conducts a discharge to charge or destaticize said photosensitive body and which includes a grid, a substance which decomposes or adsorbs discharge products being disposed on a face of said grid which opposes a discharging portion;

an opening portion which opens downward or obliquely downward toward said photosensitive body and which has at least partly a stagnant portion in which discharge products produced by a discharge caused by said discharging means stagnate; and a partition member which is disposed in the whole of an opening of said opening portion, said opening opposing said photosensitive body, said partition member being continuously adjacent to said grid.

3. An image forming apparatus according to claim 1, wherein said apparatus further comprises:

discharging means comprising a scorotron discharger; and a partition member which is elongated integrally with a member for forming a grid of said scorotron discharger.

4. An image forming apparatus according to claim 1, wherein said apparatus further comprises a partition member which is disposed at least in a face of said opening portion in the vicinity of an opening opposing said photosensitive body, said face opposing said stagnant portion, said partition member made of a substance which decomposes or adsorbs discharge products which fall from an interior of said stagnant portion.

5. An image forming apparatus according to claim 1, wherein said apparatus further comprises an opening portion which opens downward or obliquely downward toward said photosensitive body and which includes at least partly a stagnant portion in which discharge products produced by a discharge caused by said discharging means stagnate, a layer made of a material which decomposes or adsorbs discharge products being formed on an inner wall.

6. An image forming apparatus comprising:

latent image forming means for forming a latent image on a photosensitive body;

developing means for developing the latent image to form a developed image;

transferring means for transferring a corona discharger which conducts a discharge to charge or destaticize said photosensitive body;

an opening portion which opens downward or obliquely downward toward said photosensitive body and which has at least partly a stagnant portion in which discharge products produced by a discharge caused by said discharging means stagnate;

a partition member which is disposed in the vicinity of an opening of said opening portion, said opening opposing said photosensitive body, said partition member preventing discharge products which fall from an interior of said stagnant portion, from further falling to directly contact with said photosensitive body; and an erase lamp at a position opposite to said discharging means with said opening portion between, said erase lamp destaticizing said photosensitive body, wherein said partition member is disposed at a position at which light emitted from said erase lamp and advancing to a portion of said photosensitive body is blocked, said portion opposing said discharging means.

* * * * *